United States Patent [19]

Mattsson

[11] 4,131,825

[45] Dec. 26, 1978

[54] DITHERABLE AND TUNABLE MAGNETRON COMPRISING AXIALLY TUNING AND ROTATIONAL TUNING MEMBERS

[75] Inventor: Lennart P. J. Mattsson, Järfälla, Sweden

[73] Assignee: U.S. Philips Corporation, New York, N.Y.

[21] Appl. No.: 798,317

[22] Filed: May 19, 1977

[30] Foreign Application Priority Data

May 21, 1976 [SE] Sweden ..... 7605765

[51] Int. Cl.[2] ..... H01J 25/50

[52] U.S. Cl. ..... 315/39.61; 315/39.51; 315/39.55

[58] Field of Search ..... 315/39.51, 39.61, 39.55, 315/39.77

[56] References Cited

U.S. PATENT DOCUMENTS

| | | | |
|---|---|---|---|
| 2,931,943 | 4/1960 | Backmark | 315/39.61 |
| 3,247,421 | 4/1966 | Backmark | 315/39.61 |
| 3,333,148 | 7/1967 | Buck | 315/39.77 X |
| 3,441,795 | 4/1969 | Hynes et al. | 315/39.61 |
| 3,441,796 | 4/1969 | Cooper | 315/39.61 |
| 3,731,137 | 5/1973 | Foreman | 315/39.61 |

*Primary Examiner*—Saxfield Chatmon, Jr.
*Attorney, Agent, or Firm*—Algy Tamoshunas

[57] ABSTRACT

A tunable magnetron is disclosed comprising a first tuning body rotatable in an annular groove formed by axial slots in the anode plates for rapidly varying the magnetron frequency. The rapid frequency tuning is combined with a slow or quasi-stationary frequency variation produced by a second axially displaceable tuning body having conductive projections which extend into the resonant cavities between adjacent anode plates from the end thereof opposite the first rotatable tuning body. The entire tuning range of the first tuning body is shifted along the frequency scale by an axial displacement of the second tuning body.

9 Claims, 3 Drawing Figures

DITHERABLE AND TUNABLE MAGNETRON COMPRISING AXIALLY TUNING AND ROTATIONAL TUNING MEMBERS

The invention relates to a tunable magnetron comprising a central cathode, surrounded by a ring-shaped anode block with inwardly projecting, radial anode plates forming sector-shaped resonance cavities therebetween and means for generating an axial magnetic field in the interaction space between the cathode and the inner ends of the anode plates. Each anode plate, furthermore, is provided with an axial open ended slot. The slots are all spaced a predetermined distance from the inner wall of the anode block so that they form a continuous slot or groove for receiving a tuning body or member of generally sleeve-shaped form. The tuning member is rotatable and the portion thereof projecting into the groove has a quantity of conductive material which varies along the circumference, for producing a periodic rapid tuning variation during the rotation of the member.

The object of the invention is to permit the tuning range of such a magnetron, to be varied. This object is achieved by combining rapid periodic tuning variation with a slow or quasi-stationary tuning variation produced by a second, axially displaceable tuning body or member having electrically conductive, portions projecting axially into the resonant cavities between the anode plates from the side thereof opposite the first tuning member. The magnetron of the invention also includes an externally actuatable means for producing axially displacing the second tuning member.

It has been found that such a second tuning body when displaced axially during rotation of the first tuning body will produce a shift of the tuning range obtained by the first member along the frequency scale without decreasing the size of tuning range. Furthermore, the second tuning member produces a variation of the resonant frequency with changes in temperature, which is opposite to the tuning variation produced by the first tuning member due to varying temperature, so that the resulting resonant frequency variation with temperature can be made to be substantially equal to zero across the entire operating range.

Figure 1:
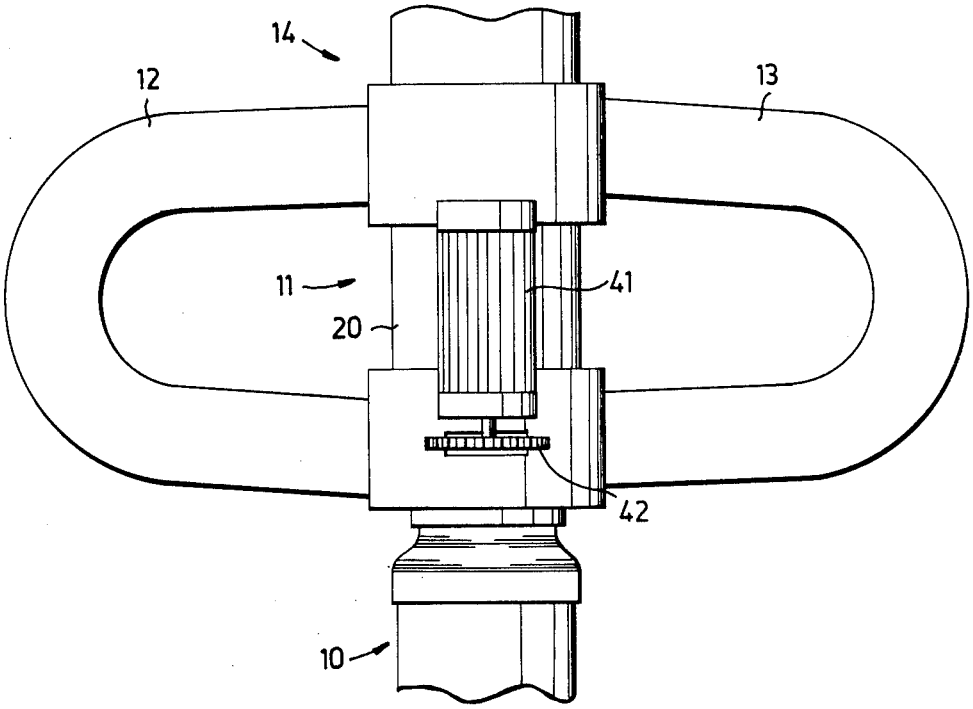
Figure 3:
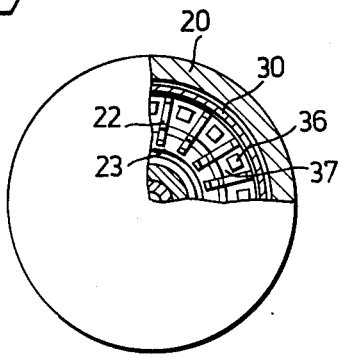
Figure 2:
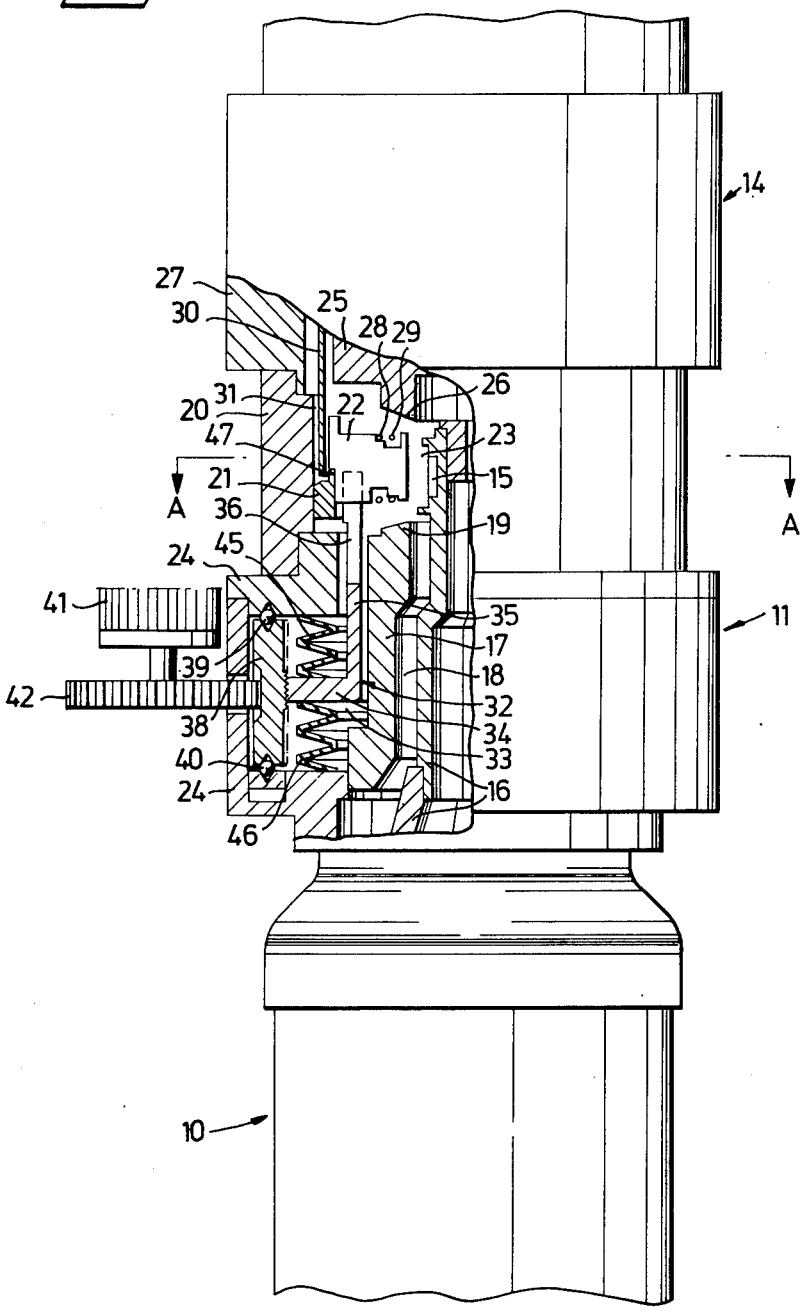

The invention is illustrated in the accompanying drawings, in which:

FIG. 1 shows a side view of a magnetron provided with a tuning device according to the invention, FIG. 2 shows a side view, partly in section, of the magnetron according to FIG. 1 illustrating the tuning device in detail, and FIG. 3 shows a sectional view along the line A—A in FIG. 2.

The shown magnetron of the invention shown in FIG. 1 includes a base 10, an upper portion 14 and a central portion 11 provided with two strong horseshoe-shaped permanent magnets 12, 13. The base contains the required electric connections and a connection to an evacuation apparatus, while the central portion contains the interaction space. The upper portion contains journalling and coupling means for driving a rotatable tuning body hereinafter described in greater detail.

As shown in FIG. 2 mounted centrally within the magnetron is a cylindrical cathode 15 which is supported on the base 10 by cylindrical member 16. Attached to the base 10 is a lower magnetic pole ring 17 disposed co-axially with and spaced from the support member 16 to form an annular gap 18 therebetween.

The upper central portion 19 of the pole ring 17 forms a ring-shaped pole shoe. Spaced from the cathode 15 and co-axial with it is an outer copper anode ring 20. The anode ring is arranged between a lower magnetic pole block 24 consisting of two parts and an upper magnetic pole block 27. Disposed on the inner side of the outer anode ring 20 is an inner anode ring 21 which supports a number of radially arranged anode plates 22. The anode plates 22 terminate at a point spaced from the cathode 15, so that their inner ends and the cathode 15 form an interaction space 23 therebetween. The permanent magnets 12, 13 (FIG. 1) produce in the space 23 a strong axial magnetic field. The magnetic circuit leading the magnetic flow from the permanent magnets 12, 13 to the interaction space 23 comprises the two magnetic pole blocks 24, 27 and the lower magnetic pole ring 17, the upper surface 19 of which forms one of the pole shoes. An upper magnetic pole ring 25 with the second pole shoes 26 are also included in the magnetic circuit. The sectorshaped spaces between the individual anode plates 22, which are limited outwardly by the outer and inner anode ring 20 and 21, respectively, form resonant cavities. Alternate anode plates are interconnected by conductors or straps 28, 29 and the intermediate anode plates are also in turn similarly mutually interconnected. Means (not shown) are furthermore arranged for momentarily applying a high electric voltage between the anode ring 20 with its anode plates 22 and the cathode 15. The high frequency energy is derived in the usual manner by means, such as a probe, projecting into one of the resonant cavities.

Only the lower portions of anode plates 22 are attached to the inner anode ring 21, which in turn is attached to the inner side of the outer anode ring. The upper portions of the plates 22 are free so that a gap 31 is formed between each anode plate and the inner wall of the outer anode ring 20. The gap 31 extends to the upper edge of the inner anode ring 21. The gaps between the individual anode plates and the outer anode ring form an upwardly opening annular groove into which projects the lower end of a first cylindrical tuning body 30. The tuning body 30 is rotatably supported in the upper portion 14 of the magnetron and in operation is continuously rotated by means of an electric motor.

The lower part of the tuning body 30, which extends into the groove formed by the gaps 31 between the anode plates 22 and the anode ring 20 is provided with a peripherally varying quantity of conductive material. For example, the lower portion of the tuning body 30 projecting into the resonant cavities between the plates 22 may be serrated, e.g. toothed, or provided with apertures. When the body rotates, the groove is filled to a varying degree with conductive material which in turn results in a periodic variation of the tuning determined by the resonant cavities. Triggering or excitation of the magnetron is produced by an instantaneously applied high voltage between the anode block, comprising the anode ring 20 and anode plates 22, and the cathode 15. The frequency of the generated high frequency pulse is dependent on the instantaneous tuning frequency at the moment of triggering. The tuning member 30 rotates with a relatively high speed, for example 4000 rpm, and the tuning variation produced by member 30 is called rapid tuning.

According to the invention the rapid tuning is combined with a slow or quasi-stationary tuning produced by a second, axially displaceable tuning body 32. The second tuning body 32, which is arranged in the space 33 between the magnetic pole ring 17 and the magnetic pole block 24, includes ring-shaped part or radial flange 34 and an axial or cylindrical portion 35. The cylindrical portion of body 32 may be a continuous cylinder with separate pins or teeth 36 extending axially from its upper end. The pins 36 are arranged with the same pitch as the resonant cavities and extend into the resonant cavities 37 between the anode plates as shown in FIG. 3. At least the upper portions of the pins which project into the resonant cavities are made of electrically conductive material.

As shown in FIG. 3, the shape of the portions of the pins 36, which project into the resonant cavities, is such that they correspond substantially to the form of the sector-shaped resonance cavities 37. In this way maximal filling of the resonant cavities with conductive material will be obtained for each position of the second tuning body.

The second tuning body 32 slips over the outer surface of the magnetic pole ring 17 so that it is axially displaceable in the space 33. The body 32 is displaced axially by means of an adjustment ring 38, which is provided with an internal gear on its inner surface. The internal gear cooperates with an outer gear on the periphery of the annular portion 34 of the second tuning body 32. The adjustment ring 38 is rotatably journalled in two ball bearings 39, 40 seated in V-shaped slots in the end surfaces of the ring 38 and in the fixed portions of the magnetic pole block 24. Rotation of ring 38, and consequently displacement of the second tuning body 32, is effected by means of an electric motor 41 having a gear wheel 42 arranged on the motor shaft in engagement with an outer gear on the adjustment ring. A bellow 45 is arranged between the upper side of the radial flange 34 of the tuning body 32 and the opposite surface of the magnetic pole body 24. Similarly, a second bellows 46 is arranged between the lower side of flange 34 and an attachment point in the pole ring 17. The bellows 45 and 46 permit the second tuning body 32 to be displaced axially under of vacuum conditions within the magnetron.

In the embodiment shown in the FIGURE a thin ring 47 projects from the inside of the inner anode ring 21 into the resonant cavities at the rear ends thereof. Ring 47 forms a separating wall between the first tuning body 30 and the pins 36 on the second tuning body 32 when the pins 36 overlap the lower end of the first tuning body 30 upon maximal displacement of body 32 toward the anode plates.

In operating the magnetron, the first tuning body is rotated continuously so that the tuning frequency varies cyclically within a given frequency range with a period determined by the rotational speed of the body. The magnetron is triggered instantaneously by the application of a high voltage at given moments during the periodic tuning variation generating a high frequency pulse. The frequency of the generated pulse is dependent on the instantaneous tuning frequency at the moment of triggering. If triggering is effected arbitrarily and independently of the periodic tuning variation, pulses with a frequency varying at random within the tuning range will be obtained. If, on the other hand triggering is effected at predetermined measured tuning frequencies, pulses with corresponding frequencies will be obtained. The second tuning body 32 is normally stationary during operation.

If it is desired to shift the entire tuning range produced by the first tuning body along the frequency scale, the second tuning body 32 is moved axially toward or away from the anode plates by a corresponding clockwise or counter clockwise rotation of gear 42 upon activation of motor 41. The tuning variation produced by the second body is effected slowly and can be called slow tuning. It has been shown that in the above described construction wherein slow tuning is produced by a tuning body protruding into the resonance cavities from a direction opposite to the direction in which the first tuning body protrudes into the cavities, the slow tuning will not adversely affect the tuning range of the first tuning body. On the contrary, in certain cases a small increase in the tuning range has been measured. The tuning range produced by the second tuning body can be easily made to exceed the tuning range produced by the first body. In one example the tuning range produced by the first body is 450 MHz and the tuning range produced by the second body is 650 MHz.

A favourable effect of the second tuning body in the described embodiment is that it gives rise to a variation in the resonance frequency due to temperature changes which is opposite to the variation obtained due to the first tuning body at a corresponding temperature variation. That is with increase in temperature, the first tuning body gives rise to a decreasing tuning frequency and a decreasing tuning range, while the second body produces an increase of the tuning frequency when the temperature increases. By choosing suitable shapes and materials for the tuning bodies the two temperature effects can be made to cancel each other so that the resulting variation in the tuning frequency with changes in temperature will be practically negligible for the entire operating temperature range.

What is claimed is:

1. A tunable magnetron comprising a cathode, an anode including an annular member disposed about and spaced from said cathode and a plurality of anode plates spaced about the inner wall of said annular member and extending radially therefrom toward said cathode, each pair of adjacent anode plates defining a resonant cavity therebetween, the inner ends of said anode plates adjacent said cathode being spaced from and defining with said cathode an interaction spaced therebetween, said anode plates each defining an axial slot, the slots defined by said anode plates forming an annular groove extending about the axis of said annular member, means for producing an axial magnetic field in said interaction space, a first tuning member rotatable about an axis generally parallel to the axis of said annular member and having an end portion extending into said groove, said end portion of said first tuning member having a circumferentially varying quantity of electrically conductive material so that a periodic rapid variation in the frequency of the magnetron is produced upon movement of said end portion in said groove during rotation of said first tuning member, and a second axially displaceable tuning member disposed on the side of said anode plates opposite said groove, said second tuning member having at least one electrically conductive axial projection extending into at least one of said resonant cavities for varying the frequency of the magnetron upon axial displacement of said second tuning member.

2. The magnetron according to claim 1 wherein said end portion of said first tuning member extending into said groove is tubular.

3. The magnetron according to claim 2 wherein said tubular end portion extending into said groove has a plurality of apertures formed therethrough.

4. The magnetron according to claim 2 wherein the tubular end portion extending into said groove is serrated.

5. The magnetron according to claim 1 wherein said second tuning member has a plurality of said axial projections each extending into an associated one of said resonant cavities.

6. The magnetron according to claim 5 wherein said axial projections are arranged on the end of said second tuning member adjacent said anode plates along a circle substantially coaxial with said axis of said annular member, the radius of said circle being smaller than that of said annular groove so that said projections are further from said inner wall than said end portion of said first tuning member extending into said groove.

7. The magnetron according to claim 6 wherein the axial length of said projections is such that upon maximal displacement of said second tuning member toward said anode plates, said projections overlap said end portion of said first tuning member in the axial direction.

8. The magnetron according to claim 7 including an annular partition of conductive material extending between said anode plates and disposed in said resonant spaces at a position such that upon said maximal displacement of said second tuning body, said annular partition is interposed between the overlapping portions of said axial projections and said end portion of said first tuning member.

9. The magnetron according to claim 8 wherein said second tuning member includes a hollow cylindrical portion which is coaxial with said axis of said annular member and said projections are formed by teeth extending axially from the end of said cylindrical portion adjacent said anode plates and including means for axially displacing said second tuning member toward and away from said anode plates.

* * * * *

UNITED STATES PATENT OFFICE

CERTIFICATE OF CORRECTION

Patent No. 4,131,825 Dated December 26, 1978

Inventor(s) LENNART P.J. MATTSSON

It is certified that error appears in the above-identified patent and that said Letters Patent are hereby corrected as shown below:

Claim 1, line 46, "spaced" should be --space--

Signed and Sealed this

*First* Day of *May 1979*

[SEAL]

*Attest:*

RUTH C. MASON
*Attesting Officer*

DONALD W. BANNER
*Commissioner of Patents and Trademarks*